United States Patent [19]

Crute

[11] Patent Number: 4,755,191

[45] Date of Patent: Jul. 5, 1988

[54] FINISHING OF HARD CHROMIUM PLATED PRODUCTS

[75] Inventor: Henry D. Crute, Pottstown, Pa.

[73] Assignee: LaSalle Steel Company, Hammond, Ind.

[21] Appl. No.: 882,458

[22] Filed: Jul. 8, 1986

Related U.S. Application Data

[63] Continuation-in-part of Ser. No. 749,429, Jun. 27, 1985, abandoned.

[51] Int. Cl.[4] ..... B24D 3/00

[52] U.S. Cl. ..... 51/293; 51/309

[58] Field of Search ..... 51/293, 304, 308, 309

[56] References Cited

U.S. PATENT DOCUMENTS

| | | | |
|---|---|---|---|
| 1,986,388 | 1/1935 | Calcott et al. | 106/8 |
| 2,548,582 | 4/1951 | Boak | 51/304 |
| 2,649,362 | 8/1953 | Fowler | 51/304 |
| 3,419,902 | 12/1968 | Gerber et al. | 51/304 |
| 3,498,768 | 3/1970 | Geld et al. | 51/304 |
| 3,619,962 | 11/1971 | Combe | 51/304 |
| 4,071,333 | 1/1978 | Like | 51/304 |
| 4,182,686 | 1/1980 | Laks et al. | 51/304 |
| 4,451,269 | 5/1984 | Makedonski et al. | 51/309 |

*Primary Examiner*—Paul Lieberman
*Assistant Examiner*—Willie J. Thompson
*Attorney, Agent, or Firm*—Fitch, Even, Tabin & Flannery

[57] ABSTRACT

A process for the finishing of hard chromium plated products which consists of polishing followed by friction finishing with an organic compound which contains abrasive particles. The organic compound consists of fatty acids derived from either animal or vegetable sources. The abrasive particles consists of oxides of aluminum, silicon, chromium, titanium, magnesium, or silicon. Nitrides or carbides of these metals could also be used as abrasive agents. This friction finishing compound is applied using specific pressure and surface velocity under dry conditions, and the product which results from using this technique has improved corrosion resistance and improved surface finish.

6 Claims, 6 Drawing Sheets

AS-PLATED SURFACE

PLATED AND POLISHED SURFACE

FRICTION FINISHED SURFACE

AS-PLATED SURFACE

PLATED AND POLISHED SURFACE

FRICTION FINISHED SURFACE

DEFECTS IN THE AS-PLATED SURFACE

DEFECT IN THE PLATED AND POLISHED SURFACE

DEFECT IN THE FRICTION FINISHED SURFACE

CORRODED AREA ON THE AS-CHROME PLATED SURFACE

CORRODED AREA ON THE AS-CHROME PLATED SURFACE

CORRODED AREA ON THE PLATED AND POLISHED SAMPLE

A DEFECT ON THE FRICTION FINISHED SURFACE THAT DID NOT CORRODE DURING SALT SPRAY TESTING

BEFORE AFTER

PLATED AND POLISHED BARS BEFORE AND AFTER SALT SPRAY TESTING

BEFORE AFTER

FRICTION FINISHED BARS BEFORE AND AFTER SALT SPRAY TESTING

FINISHING OF HARD CHROMIUM PLATED PRODUCTS

This application is a Continuation-In-Part of Ser. No. 749,429, filed June 27, 1985, abandoned.

This invention relates to the finishing of chromium plated products, and more specifically to a method of friction finishing the chromium surface of a steel plated product to improve corrosion resistance.

Hard chromium plating is produced by electrodeposition from a solution containing chromic acid and catalytic anions in proper proportion. The metal deposit thus produced is extremely hard and the chromium coating per se provides some corrosion resistance. The chromium deposit that results from the electroplating process contains cracks, nodules, and other surface defects which must be removed before the product can be used in many applications, for example, piston rods. These microscopic defects detract from the surface appearance, and can serve as corrosion sites when the product is exposed to a corrosive environment. Polishing of the chromium surface with aluminum oxide is conventionally practiced to minimize the detrimental effects of these defects. The aluminum oxide polishing operation levels the nodules and tends to fill in the cracks in the chromium deposit. The polishing operation results in a significant improvement in the surface appearance, and the corrosion resistance of the product is also improved. The quality and corrosion resistance of the polished hard chromium deposit depends upon the size of the aluminum oxide particles used, the type of wheels or belts used, polishing speeds, and a variety of other processing parameters. The chromium surface produced using aluminum oxide polishing is sufficient for many industrial applications.

Some applications require that the hard chromium plated product have a greater level of corrosion resistance than that which is provided by aluminum oxide polishing. For example, to improve corrosion resistance, some specifications state that a layer of nickel plate must be deposited underneath the chromium plating. The nickel layer provides a barrier protecting the base metal from the environment in areas where defects in the hard chromium deposit occur. The present invention improves the corrosion resistance of the plated chromium surface to a degree that a nickel plate undercoat is not required to prevent corrosion. This reduces the cost of the product and makes the hard chromium plated product acceptable for a wider range of applications.

It has been discovered that a secondary friction finishing treatment using particular buffing compounds results in significant improvements in the corrosion resistance of an electroplated chromium surface and also results in improvements in the overall finish of the surface. The buffing compound comprises an organic material containing long chain molecules and fine abrasive particles as additives. It is the combined action of the fine particles and the organic material that result in a chromium surface possessing improved corrosion resistance. The improved corrosion resistance is believed to be the result of the sealing of the microscopic defects in the chromium surface.

It has also been discovered that the protection provided by this friction finishing treatment is not affected by subsequent cleaning of the treated surface with solvents or detergents. Hence the friction finished steel part can be thoroughly cleaned prior to assembly into a larger machine, and the corrosion protection will not be diminished.

It is well-known that chromium oxidizes rapidly in air to produce an adherent oxide surface coating. The formation of this tough, adherent oxide film prevents further oxidation of the chromium. The chromium oxide film is transparent and the chromium surface has a lustrous metallic appearance even though it is oxidized. While the presence of the oxide film is generally beneficial, it prevents the application of additional protective coatings. Hence a hard chromium plated surface which contains microscopic defects is difficult to protect from corrosion because the oxide layer prevents organic materials from adhering to the surface.

The chromium oxide film forms instantaneously when the plated product is removed from the plating bath and exposed to oxygen in the air. The oxide film is removed temporarily during polishing, but it reforms again very rapidly. Hence a protective coating cannot be effectively applied after polishing due to the presence of an oxide film which interferes with surface adhesion.

It has been discovered that removing the oxide film at elevated temperatures with fine abrasive particles in the presence of organic compounds makes it possible to effectively bind the organic compounds to the chromium surface. When the organic molecules come into contact with the oxide free chromium surface they are tightly held in place by intermolecular forces at the surface. Thereafter, a fresh chromium oxide film forms around the organic molecules further adhering these molecules to the surface. The organic molecules effectively seal the cracks and other microscopic defects in the plated chromium surface thereby preventing corrosion. Also, the organic molecules are so tightly adhered to the surface that they cannot be removed by solvents. Hence, the parts can be solvent cleaned without diminishing the corrosion protection.

An additional advantage of the friction finishing process is a significant improvement in surface finish. When fine abrasive particles are used in the friction finishing compound the scratch pattern on the surface can be refined and the surface topography reduced. This improves the product's appearance and reduces the surface coefficient of friction. These surface changes are generally considered beneficial to the product.

The friction finishing process used in the present invention consists of several essential steps. The chrome plated article must first be dried because the presence of water during the friction finishing diminishes the quality of the finish. The preferred method of drying of work is with an air spray, but any drying method which removes the water would be acceptable.

The friction finishing compound is then applied to the surface of the part under conditions which cause the temperature of the surface of the part to be elevated. The surface temperature of the part should be raised to at least 500° F. (260° C.) during application of the finishing compound, preferably to at least 750° F. (400° C.). The upper temperature limit is that temperature at which the friction finishing compound applicator ignites.

Elevation of the surface temperature of the part is created by friction between the surface of the part and the finishing compound applicator. In most instances, and particularly when the part is round, e.g., a round bar, the bar is rotated in a suitable fixture and the applicator is a buffing wheel. The buffing wheel preferably includes a hub which acts as a heat sink to prevent the wheel from igniting. Since the fixture holding the bar conventionally operates at a fixed speed, for example 295 surface feet per minute, the rpm of the bar being treated will vary depending upon its diameter; a one inch diameter bar will be rotated at approximately 1127 rpm and a six inch diameter bar will be rotated at approximately 188 rpm.

A preferred form of applicator is a sisal buffing wheel. To create the requisite friction to elevate the surface temperature of the bar, the buffing wheel is operated at a high surface velocity relative to the bar stock being treated. Since a sisal buffing wheel wears away during use, the surface velocity of the wheel applied to the rotating bar stock will vary. With the bar stock and wheel rotating in the same direction the relative surface velocity between the two, i.e., the difference between the surface velocity of the wheel and the surface velocity of the bar stock, is betweeen about 6500 and 10,000 surface feet per minute (SFM). The buffing wheel is urged into contact with the bar stock under pressure which further increases the friction and the temperature. This may be accomplished using a conventional air actuated biasing linkage. If desired, as the sisal applicator wheel wears and its diameter is reduced, the pressure may be increased and/or the wheel speed may be increased to maintain the desired surface temperature.

The surface temperature of the part after friction finishing should be between about 125° and about 150° F. (50°-65° C.), preferably about 140° F. (60° C.). If this temperature is measured, for example with an optical pyrometer, after disengagement between the part and applicator, this temperature measurement can be used to control the process.

The friction finishing compound is selected in order to provide a desired finish on the part. The finishing compound comprises abrasive particles dispersed in a suitable organic vehicle which may be composed of fatty acids and/or fatty acid esters having 8 to 18 carbon atoms, animal fat, vegetable fat, lanolin and mixtures thereof. A surfactant may be added if desired, as well as other ingredients typically found in finishing and polishing compounds, for example additives for pH control and gelling agents. In order to achieve the improved corrosion resistance of the invention, it is necessary that the finishing compound be essentially free of water.

The abrasive particles in the finishing compound may be any of those typically used, for example oxides, carbides or nitrides of iron, chromium, aluminum, titanium, silicon, magnesium or calcium. In order to provide the desired result, the average particle size of the abrasive should be less than 15 microns, and preferably 90 percent of the abrasive particles should have a particle size of less than 15 microns. Typically the abrasive particles comprise between about 50 and about 90 weight percent of the finishing compound.

The use of various polishing compounds to finish surfaces has been suggested in the prior art. For example, U.S. Pat. No. 1,986,388—Calcott et al. describes a metal polish composed of fatty acids, an organic solvent which is immiscible with water, and abrasive and a wetting agent. This invention differs from the present invention in several aspects including the use of water with the polish and the method of application. The process described in the Calcott et al. patent does not teach working the compound into the surface with pressure to seal the surface and thereby provide corrosion resistance. Instead the polish described leaves behind a waxy film to provide protection. This waxy film can be removed by solvents while the protection provided by the present invention cannot be removed by solvents.

U.S. Pat. No. 3,419,902—Gerber et al. describes another polishing compound made from fatty acids with a mild abrasive. However, this compound is to be applied using a polishing cloth, and the essential aspects of working the compound into the surface with pressure were not included in the techniques described in the Gerber et al. patent.

U.S. Pat. No. 3,619,962 describes a polishing compound which contains fatty acids and abrasive compounds. However, this patent describes a liquid compound which consists mostly of water. The present invention teaches that the presence of water during finishing detracts from the quality of the finished surface.

The prior art contains several references to polishing compounds containing fatty acids and mild abrasives. However, the novel aspect of the present invention lies not in the composition of the polishing compound, but in the method of applying it to the surface of a steel workpiece which has been chromium plated. Sufficient pressure must be applied to remove the hard chromium oxide and work the friction finishing compound into the microscopic defects in the chrome plate. Simply applying the polish to the surface by hand will not provide a surface with sufficient corrosion resistance.

The concepts of this invention will be illustrated and further explained in the examples that follow. These examples provide photomicrographs of the hard chromium deposits and of microscopic defects in hard chromium plate. They also show the effects of salt spray corrosion testing on products made using the prior art and products made using the new process. The salt spray corrosion tests discussed in these examples were conducted in accordance with ASTM Specification B-117.

EXAMPLE 1

This example is a comprehensive comparison of the hard chromium plated product in three conditions: as-plated, plated and polished, and friction finished in accordance with the present invention. The material used for this comparison test consisted of AISI 1045 steel bars which were 1.375 inch in diameter. These bars were induction hardened in accordance with conventional practices, polished, and then plated using a dual catalyst hard chromium plating bath. The chromium surface thickness after plating was 0.0012 inch. Induction hardening of the steel prior to plating provides support for the thin chromium deposit and makes the product more resistant to mechanical damage. This type of hard chromium plated bar is typically used for shafting in hydraulic cylinders which requires that the chromium surface have good corrosion resistance.

Figure 1A:
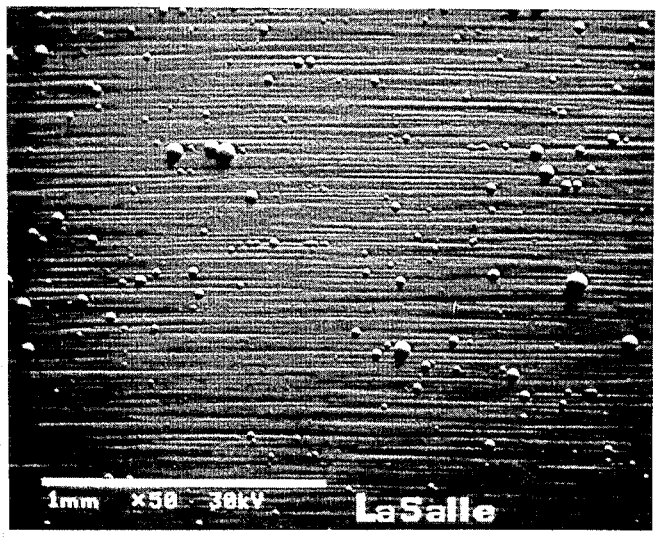
FIG. 1A is a photomicrograph showing a hard chromium plated surface as received from the plating bath and prior to any surface treatment.

FIG. 1A is a photomicrograph obtained using a scanning electron microscope showing the chromium plated surface as received from the plating bath prior to any surface treatment. The as-plated chromium surface contains some obvious nodule defects. Nodules are areas on the surface where the chromium has been deposited at a high rate resulting in a bump in the deposit surface. Nodules are usually associated with some surface abnormality on the base metal: surface dirt, a scratch, or an inclusion in the steel. It is not economically feasible to completely eliminate nodules during hard chromium plating because a perfect base metal surface would be required.

The as-plated surface also contains a scratch pattern which is a remnant of the scratch pattern that was on the base metal. The combination of the nodules and the remnant scratch pattern results in a surface which is not of the best quality. Hence polishing, typically with aluminum oxide, after plating is usually employed to remove the nodules and level the surface. The finish on the as-plated surface measured, using a profilometer, was 15–25 microinches.

Figure 1B:
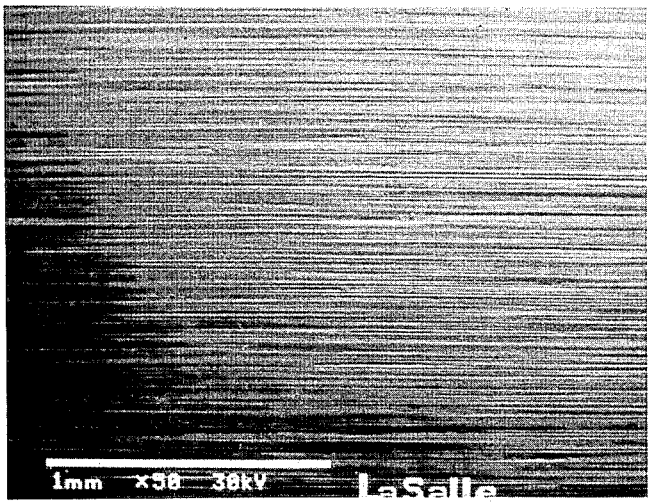
FIG. 1B is a photomicrograph showing the surface of FIG. 1A after polishing with aluminum oxide.

FIG. 1B shows the same surface after it was polished using an aluminum oxide grit and a belt polishing system. The aluminum oxide sold under the trade name Trimite was 320 grit. The belt polishing system was manufactured by G & P Machinery-Indianapolis, Ind. and the polishing was conducted at 1300 surface feet per second. As seen in FIG. 1B, the nodules have been leveled as a result of the polishing procedure and a new scratch pattern imparted by the polishing system has been established on the chromium surface. The surface finish on the polished sample was 6.5–7.5 microinches.

Figure 1C:
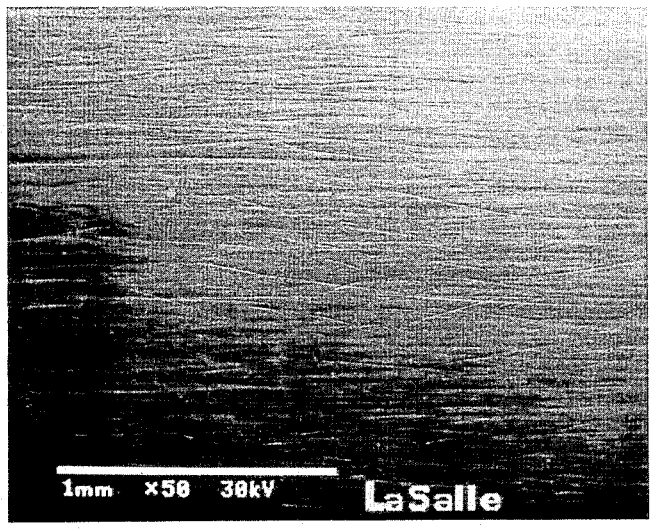
FIG. 1C is a photomicrograph showing the surface of FIG. 1B after friction finishing in accordance with the present invention.

FIG. 1C shows the surface that was produced when the same surface was friction finished in accordance with the present invention. The surface has a fine scratch pattern, and the scratches have been made in more than one direction. The surface finish was 5.0–5.5 microinches.

Figure 2A:
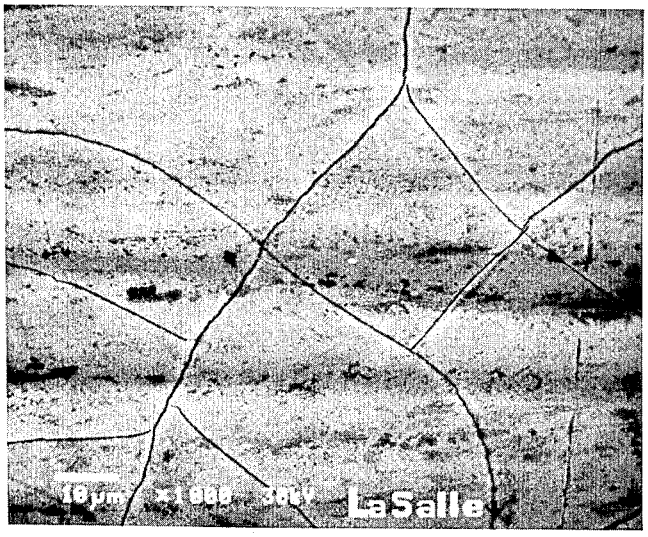
FIG. 2A is a photomicrograph of the same hard chromium plated surface as received from the plating bath and prior to any surface treatment.

The photomicrographs presented in FIGS. 1A, 1B, and 1C show the differences in the general characteristics of the chromium surface as is, after polishing, and after friction finishing. However, the magnification is too low to illustrate some of the microscopic differences that are important to the corrosion resistance of the product. FIG. 2A shows the surface of the as-plated product at a higher magnification. Note that the as-plated chromium surface has numerous cracks. Cracking of the chromium surface is caused by stresses that are introduced during plating and is unavoidable in hard chromium plating.

Figure 2B:
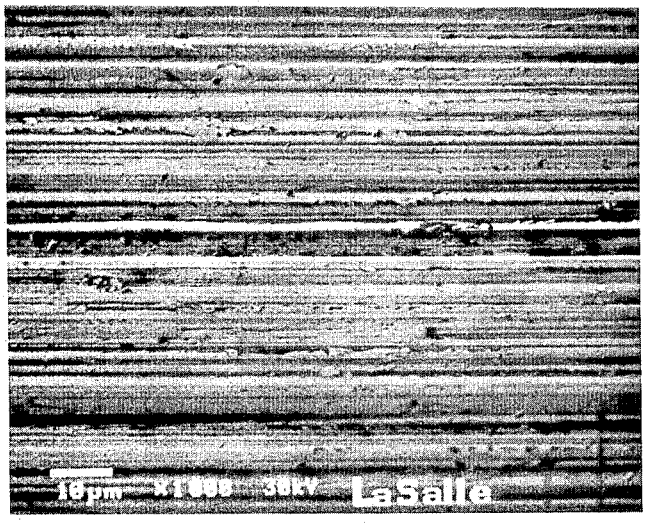
FIG. 2B is a photomicrograph showing the surface of FIG. 2A after polishing with aluminum oxide.

FIG. 2B shows the same surface after polishing with aluminum oxide. Polishing has covered most of the cracks, but shadows of the cracks can still be seen in some places. The scratch pattern which has been introduced by polishing can also be seen. These scratches are distinct and all in the same direction. The crack pattern can still be seen in some of the deeper surface scratches. While the polishing operation has eliminated most of the crack pattern, it is obvious that there are areas where the crack pattern is still exposed. These areas are potential corrosion sites.

Figure 2C:
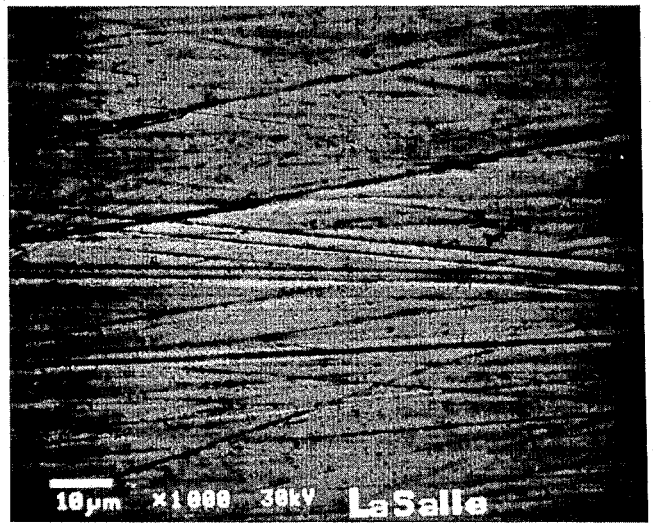
FIG. 2C is a photomicrograph showing the surface of FIG. 2B after friction finishing in accordance with this invention.

FIG. 2C shows that friction finishing in accordance with the present invention further obscures the cracks in the chromium plate. The scratch pattern established using the present process is considerably less pronounced than the scratch pattern established during polishing. Hence the cracks in the chromium deposit are not exposed. Also note that the surface shown in FIG. 2C has on it small dark particles. These particles are remnants of the organic compounds used in the friction finishing technique. Note that this material tends to fill the small scratches in the surface. Therefore, even if the crack pattern were exposed within a surface scratch, it would be sealed by this material.

It should be noted that all three samples were cleaned with soapy water and methanol prior to examination in the scanning electron microscope. The organic material deposited on the chromium surface during friction finishing was not removed by this cleaning technique. Also, the organic film was not affected by the high vacuum in which the scanning electron microscope operates. This confirms that the organic film deposited on the chromium surface during friction finishing is very tightly bound to the chromium surface.

Figure 3A:
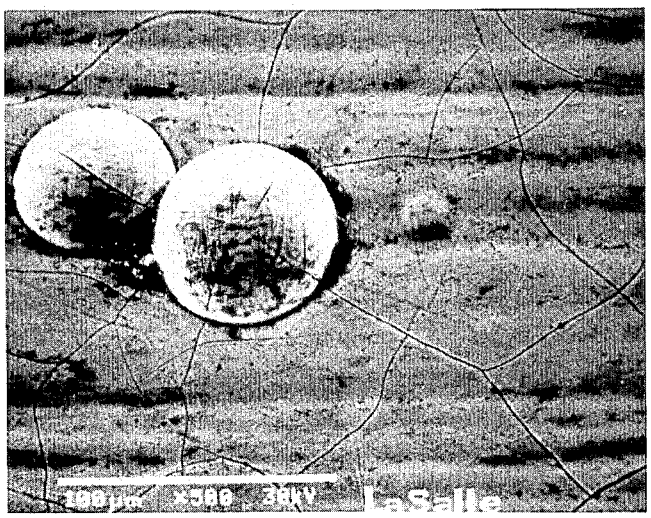
FIG. 3A is a photomicrograph of microscopic defects in the as-hard chromium plated surface.
Figure 3B:
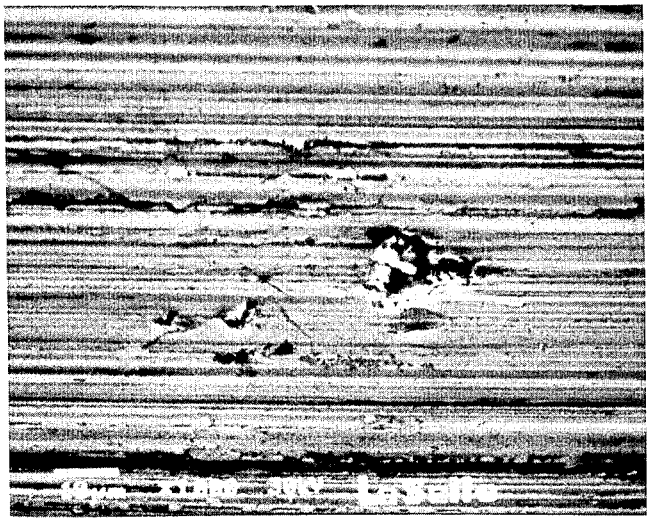
FIG. 3B is a photomicrograph of microscopic defects in the hard chromium plated and polished surface.

It was mentioned earlier that electroplated hard chromium surfaces typically contain nodule defects as well as cracks. The samples were surveyed for this type of defect using the scanning electron microscope. FIG. 3A shows nodule defects on the as-plated surface. Polishing tends to level this type of defect, but occasionally polishing causes nodules to fracture, leaving behind small nodule remnants. FIG. 3B shows a nodule remnant on the plated and polished surface. This type of surface feature is a potential corrosion site because there could be a path through the chromium plate at this point which extends to the base metal.

Figure 3C:
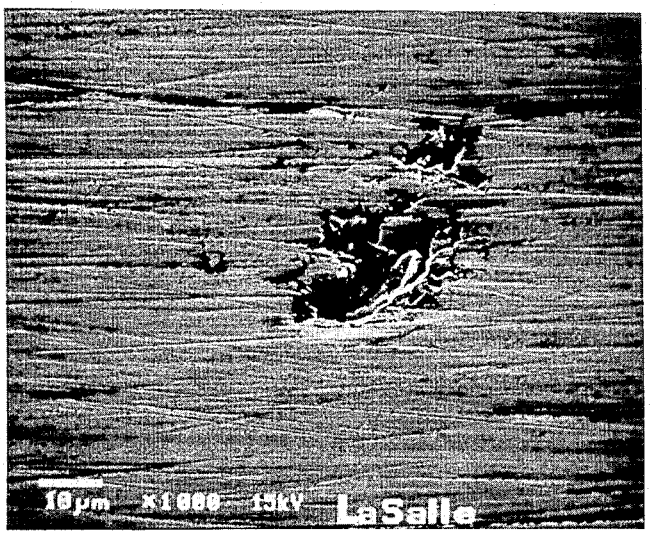
FIG. 3C is a photomicrograph of a microscopic defect in the hard chromium plated surface which was treated in accordance with this invention.

Friction finishing does not eliminate nodule remnants created by polishing. However, during friction finishing the nodule remnants are covered with organic material that inhibits corrosion. FIG. 3C shows a nodule remnant after friction finishing. The remnant is partially filled and coated over with the organic compound. The effectiveness of this sealing phenomenon on corrosion resistance is illustrated by the results of salt spray corrosion tests.

The three samples were subjected to salt spray corrosion tests to obtain a quantitative measure of their corrosion resistance. The samples were placed in a closed cabinet and subjected to a continuous spray of salt water for a period of 12 hours. Then the samples were examined and rated according to the procedures outlined in ASTM Specification B-117. This rating system uses a scale from 1–10 with 10 representing no evidence of corrosion. Then the samples were examined again at 2-hour intervals for a period of 36 hours. TABLE 1 shows the results of the salt spray corrosion tests conducted on these samples.

TABLE 1

| Time (Hours) | Salt Spray Test Results (ASTM Corrosion Ratings) As-Plated | Plated and Polished | Friction Finished |
|---|---|---|---|
| 12 | 1 | 9 | 10 |
| 14 | 0 | 7 | 10 |
| 16 | 0 | 7 | 10 |
| 18 | 0 | 7 | 10 |
| 20 | 0 | 6 | 10 |
| 22 | 0 | 6 | 10 |
| 24 | 0 | 5 | 10 |
| 26 | 0 | 4 | 10 |
| 28 | 0 | 3 | 10 |
| 30 | 0 | 2 | 10 |
| 32 | 0 | 1 | 10 |
| 34 | 0 | 1 | 10 |
| 36 | 0 | 0 | 10 |

The data presented in TABLE 1 indicate that the plated product with no surface treatment had poor corrosion resistance. This is not surprising since defects in the chromium surface made it possible for the salt water to easily penetrate to the steel substrate and initiate corrosion.

Polishing resulted in an improvement in corrosion resistance. The polishing action filled in the cracks and sealed many of the nodule defects. Consequently, the polished sample had better corrosion resistance than the as-plated sample. However, after 12 hours of exposure, the plated and polished sample began to corrode and after 36 hours was completely corroded. Friction finishing of the chromium surface in accordance with the present invention resulted in a product that resisted corrosion for the entire 36-hour exposure period. This illustrates the significant corrosion resistance that can be achieved using this processing technique.

Figure 4A:
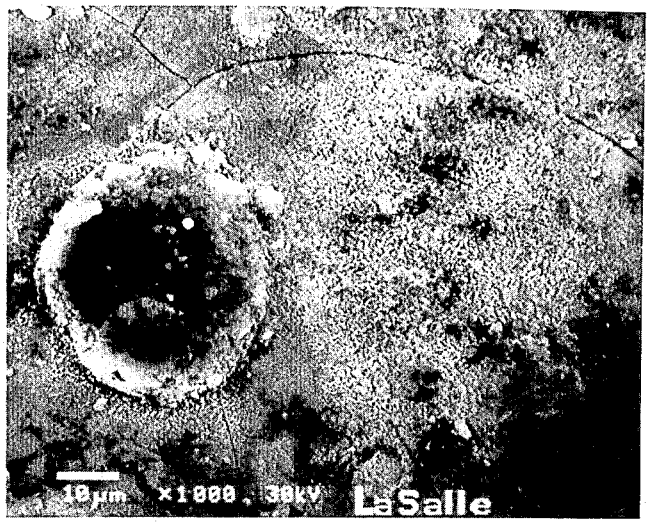
FIG. 4A shows a corroded area on the surface of the as-hard chromium plated surface after a 36-hour salt spray test.
Figure 4B:
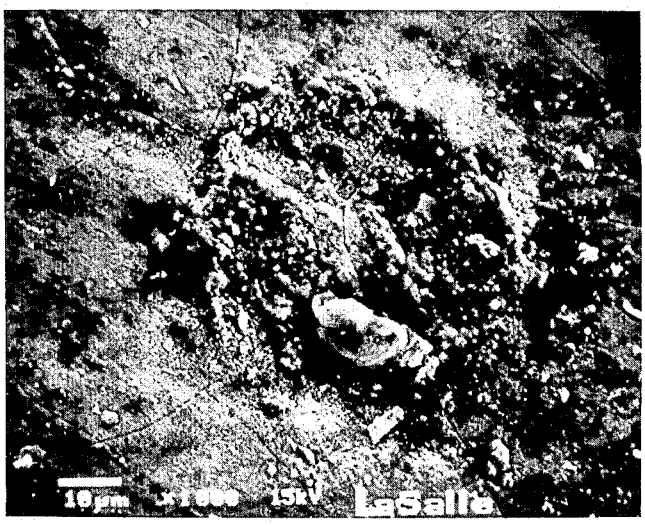
FIG. 4B shows a corroded area on the surface of the as-hard chromium plated surface after a 36-hour salt spray test.

The three samples from the salt spray test were examined using the scanning electron microscope to help explain why the as-plated and polished samples corroded and the friction finished sample did not. FIG. 4A shows a corroded area on the surface of the as-plated sample. This photomicrograph shows corrosion originating at a nodule and at a crack in the chromium surface. FIG. 4B shows more severe corrosion in the as-plated samples originating at the intersection of three cracks in the chromium surface. These photomicrographs show that the corrosion which occurs on hard chromium plated steel originates at defects in the chromium deposit. Evidently these defects provide a path from the surface to the steel substrate through which water, air, salt, and other corrosive reactants can pass. A chemical cell is then established which leads to the rapid corrosion of the steel base metal.

Figure 5:
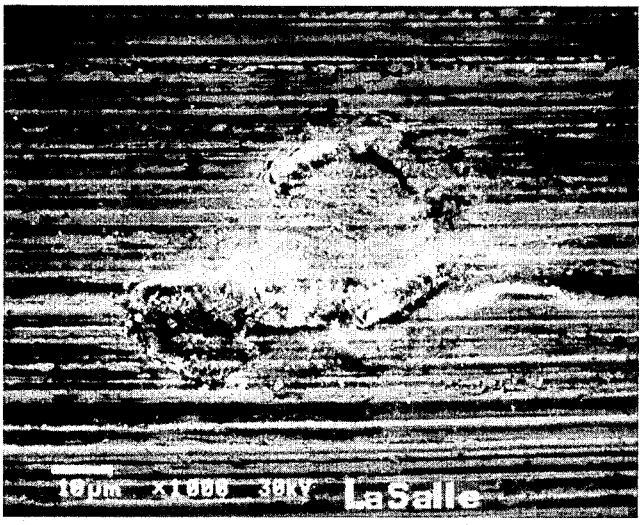
FIG. 5 shows a corroded area on the surface of the plated and polished sample after a 36-hour salt spray test.

FIG. 5 shows a small corroded area on the surface of the polished sample. The circular morphology of this area of corrosion indicates that there was a nodule present at this point on the surface prior to polishing. Polishing has flattened the nodule and sealed it to some degree, but there was evidently still a pathway at this point from the surface of the chromium to the base metal. This is further proof that corrosion of chromium plated products is related to defects in the chromium deposit. Polishing sealed most of these defects and this resulted in improved corrosion resistance. However, some nodule type defects were not effectively sealed, and after a long enough exposure corrosion occurred.

Examination of the as-plated and polished samples illustrates that corrosion of hard chromium plated products originates at defects in the deposited chromium. The friction finished sample was plated in the same bath as the other two samples, and therefore it should also contain surface defects. Indeed a previous examination of a sample which was treated in accordance with this invention revealed that there were nodule defects present. (See FIG. 3C)

However, it could be possible that the sample which was salt spray tested happened to contain no surface defects, and that is why it did not corrode. To determine whether or not the third sample contained surface defects, it was examined using the scanning electron microscope.

Figure 6:
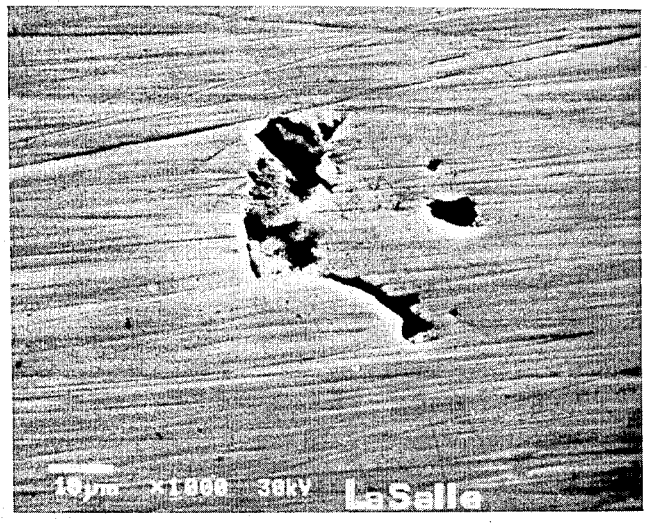
FIG. 6 shows a surface defect on the surface of the sample treated according to this invention after a 36-hour salt spray test.

FIG. 6 shows a nodule remnant in the chromium deposit from the sample which was friction finished and then salt spray tested for 36 hours. It is significant to note that there was no evidence of corrosion at this defect even on a microscopic scale. This illustrates that defects in the hard chromium deposit can be effectively sealed by friction finishing.

EXAMPLE 2

This example involves a salt spray corrosion test of another set of hard chromium plated samples. The samples used were 2¼ inch diameter shafts of AISI 1045 which had been induction hardened and plated using a dual catalyst bath. The chromium deposit thickness was 0.0013 inch. Salt spray corrosion tests were conducted on samples in the as-plated, polished, and friction finished condition. TABLE 2 shows the results of these tests. In this test the condition of the samples was assessed at 12-hour intervals.

TABLE 2

| Time (Hours) | Salt Spray Test Results (ASTM Corrosion Ratings) As-Plated | Plated and Polished | Friction Finished |
|---|---|---|---|
| 12 | 5 | 9 | 10 |
| 24 | 0 | 5 | 10 |
| 36 | 0 | 0 | 10 |
| 48 | 0 | 0 | 10 |

The results provided in TABLE 2 confirm the results of the earlier test. The product which was friction finished has superior corrosion resistance as compared to products processed in accordance with conventional practices.

Figure 7A:
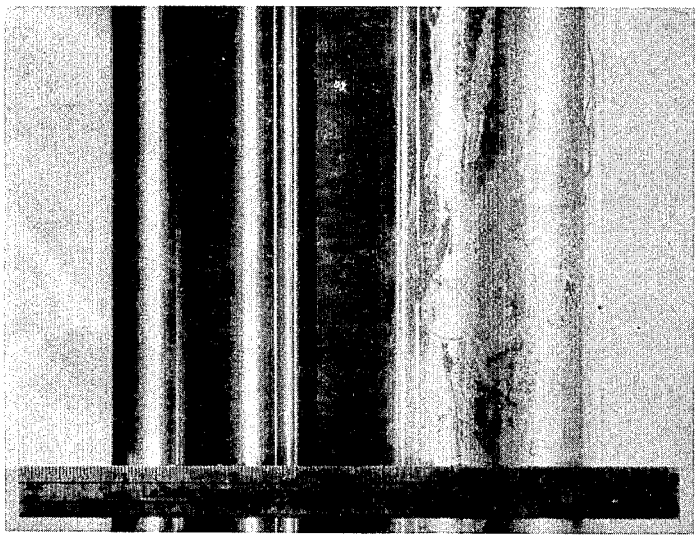
FIG. 7A shows the surface of a test sample which was treated in accordance with the prior art and a similar sample that was salt spray tested for 48 hours.
Figure 7B:
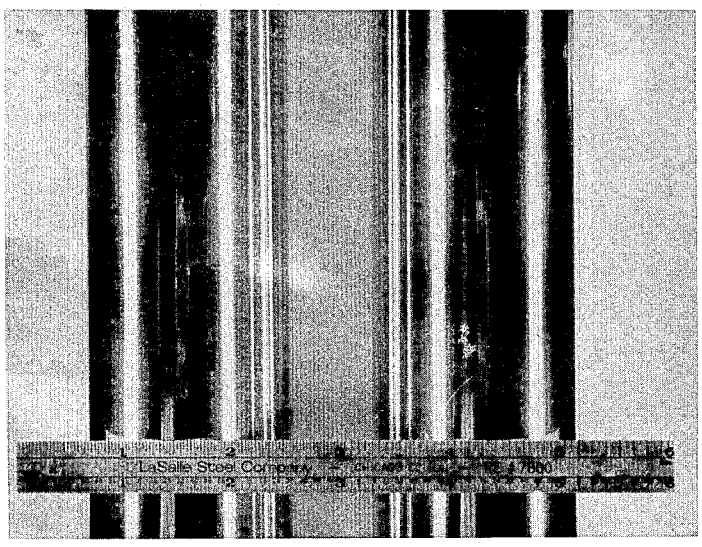
FIG. 7B shows the surface of a test sample which was treated in accordance with the teachings of this invention and a similar sample which was salt spray tested for 48 hours.

FIG. 7A is a photograph of the product made using the prior art as it appeared before and after salt spray corrosion testing. FIG. 7B shows the samples treated in accordance with the new process before and after salt spray testing. The improvement in corrosion resistance that can be achieved using the new process is evident from these photographs and the results of salt spray corrosion testing.

The surface finish of the three samples was also measured using a profilometer and the results were: as-plated —10 micro inches, plated and polishes —6 micro inches, and plated, polished, friction finished —5 micro inches. These data illustate that the new processing technique provides a surface which has lower surface roughness. This is an additional advantage of the present invention.

EXAMPLE 3

This example demonstrates that the surface protection provided by the present process cannot be removed with solvents or detergent. A series of samples was produced from a single induction hardened bar 1½ inch in diameter. This bar was plated polished and friction finished using the same techniques described earlier. Samples were cut after plating, after polishing and several samples were cut after friction finishing. Then several of the friction finished samples were cleaned with solvents. Finally, all samples were subjected to salt spray tests. TABLE 3 shows the results of these tests.

TABLE 3

Salt Spray Test Results - Solvent Tests (ASTM Corrosion Ratings)

| Time | As-Plated Sample | Plated & Polished | Friction Finished | Friction Finished and Cleaned with Alchol | Toluene | Acetone | Detergent |
|---|---|---|---|---|---|---|---|
| 12 | 10 | 10 | 10 | 10 | 10 | 10 | 10 |
| 24 | 8 | 9 | 10 | 10 | 10 | 10 | 10 |
| 36 | 3 | 9 | 10 | 10 | 10 | 10 | 10 |
| 48 | 0 | 8 | 10 | 10 | 10 | 10 | 10 |
| 60 | 0 | 6 | 10 | 10 | 10 | 10 | 10 |
| 72 | 0 | 6 | 10 | 10 | 10 | 10 | 10 |

The data presented in TABLE 3 illustrate that the protection provided by friction finishing cannot be removed by solvents. This is important to the finished product because frequently parts are solvent cleaned before they are included in larger asssemblies. For example, a chrome plated shaft would be cleaned before it is installed in a hydraulic cylinder. If the corrosion protection could be removed by cleaning agents, it would be of no practical value in the final assembly.

The data presented in Table 3 also show the improvement in corrosion resistance of the friction finished product relative to the as-plated sample and the plated and polished sample. The as-plated sample corroded rapidly after 12 hours of exposure. The plated and polished sample had better resistance, but it too corroded during the test. The sample treated in accordance with this invention resisted corrosion for the entire test period, even after the surface had been cleaned with solvents or detergents.

The surface roughness of the samples obtained for this test was measured prior to salt spray testing using a profilometer and the results were: as-plated 32 micro-inches, plated and polished 5.7 micro-inches and treated in accordance with the new process 5.5 micro-inches. These data indicate that the new process provided the best surface finish.

EXAMPLE 4

This example demonstrates that the new process results in a chrome plated surface which is more corrosion resistant than surfaces treated with a commercial rust inhibitor. It also illustrates that the friction finishing compound must be applied using pressure to achieve the desired corrosion resistance. The same 1½ inch diameter bars that were used in Example 3 were used in this test. Samples were produced which were plated and polished, and the remainder of the bars were friction finished in accordance with this invention. One of the plated and polished samples was treated with a commercial rust inhibitor —Rustbeat (a Tower Oil porduct), using the manufacturer's recommended practice. Another plated and polished sample was treated by rubbing the friction finishing compound on the surface by hand. A third sample was treated by melting the friction finishing compound and wiping the surface with a cloth saturated in the melted compound. These samples were then subjected to a salt spray corrosion test, and the results are provided in Table 4.

TABLE 4

Salt Spray Test Results - Coating Comparison (ASTM Corrosion Ratings)

| Time | Plated & Polished | Friction Finished | Plated and Polished and treated with: Rustbeat | Cold Compound | Melted Compound |
|---|---|---|---|---|---|
| 12 | 10 | 10 | 10 | 10 | 10 |
| 24 | 9 | 10 | 10 | 10 | 10 |
| 36 | 9 | 10 | 10 | 8 | 8 |
| 48 | 8 | 10 | 9 | 8 | 8 |
| 60 | 7 | 10 | 8 | 8 | 8 |
| 72 | 6 | 10 | 8 | 7 | 7 |

The data presented in Table 4 show that the surface treated in accordance with this invention had the best corrosion resistance. Treating the plated and polished surface with a commercial rust inhibitor did result in improved corrosion resistance, but the rust inhibitor eventually broke down and the sample corroded. Using the friction finishing compound applied without pressure also provided poorer corrosion resistance. This indicates that the fricition finishing compound alone is not responsible for the improved product. In order to achieve the disired corrosion resistance the friction finishing compound must be applied with pressure and worked into the chromium plated surface.

What is claimed is:

1. A process for improving the corrosion-resistance of a chromium plated article comprising polishing a chromium plated article, drying the article to provide a moisture free chromium surface, friction finishing said chromium surface by mechanically applying a friction finishing compound under conditions which cause the temperature of said chromium surface to be increased to about 500° F., said friction finishing compound comprising abrasive particles having an average particle size of less than 15 microns dispersed in a water free organic vehicle.

2. A process in accordance with claim 1 wherein the temperature of the chromium surface is increased to above 700° F.

3. A process in accordance with claim 2 wherein the friction finishing compound is applied by a buffing wheel and wherein the relative surface velocity between the wheel and the chromium surface is between about 6,500 and about 10,000 SFM.

4. A process for improving the corrosion-resistance of chromium plated and polished steel bar stock comprising providing a chromium plated and polished bar stock the chromium surface of which is free of moisture, rotating said bar stock in a fixture, applying to the chromium surface of the rotating bar stock a friction finishing compound by means of a rotating buffing wheel under conditions which cause the temperature of the chromium surface to be increased to above 500° F., said friction finishing compound comprising abrasive particles having an average particle size of less than 15 microns dispersed in a water free organic vehicle.

5. A process in accordance with claim 4 wherein the temperature of the chromium surface is increased to above 700° F.

6. A process in accordance with claim 5 wherein the relative surface velocity between the wheel and the chromium surface is between about 6,500 and 10,000 SFM.

* * * * *